United States Patent [19]

Jamison et al.

[11] Patent Number: 4,878,622

[45] Date of Patent: Nov. 7, 1989

[54] PERISTALTIC VOLTAGE BLOCK

[75] Inventors: Chris M. Jamison; Eric A. Petersen, both of Indianapolis, Ind.

[73] Assignee: Ransburg Corporation, Indianapolis, Ind.

[21] Appl. No.: 208,774

[22] Filed: Jun. 17, 1988

[51] Int. Cl.[4] ..... B05B 5/02; F04B 43/12

[52] U.S. Cl. ..... 239/690.1; 239/708; 251/6; 417/477

[58] Field of Search ..... 239/690, 690.1, 691, 239/708, 704, 706; 417/474, 476, 477; 137/565; 251/4, 6

[56] References Cited

U.S. PATENT DOCUMENTS

| | | | |
|---|---|---|---|
| 1,655,262 | 1/1928 | Fortin . | |
| 2,414,355 | 1/1947 | Bogoslowsky | 103/149 |
| 2,547,440 | 4/1951 | Clark et al. | 174/1 |
| 2,673,232 | 3/1954 | Silsby, Jr. | 174/15 |
| 3,098,890 | 7/1963 | Peterson | 174/5 |
| 3,122,320 | 2/1964 | Beck et al. | 239/3 |
| 3,138,111 | 6/1964 | Kling et al. | 417/477 |
| 3,140,666 | 7/1964 | Currie | 417/477 |
| 3,291,889 | 12/1966 | Uline et al. | 174/8 |
| 3,492,409 | 1/1970 | Williams et al. | 239/690 |
| 3,582,234 | 6/1971 | Isreeli | 251/4 |
| 3,644,068 | 2/1972 | Lepak | 417/477 |
| 3,732,042 | 5/1973 | Buchholz | 417/477 |
| 3,866,678 | 2/1975 | Jeter | 166/66 |
| 3,893,620 | 7/1975 | Rokadia | 239/3 |
| 3,899,010 | 8/1975 | Samson et al. | 417/477 |
| 3,933,285 | 1/1976 | Wiggins | 222/56 |
| 3,934,055 | 1/1976 | Tamny | 427/8 |
| 4,017,029 | 4/1977 | Walberg | 239/15 |
| 4,020,866 | 5/1977 | Wiggins | 137/592 |
| 4,085,892 | 4/1978 | Dalton | 239/15 |
| 4,159,806 | 7/1979 | Scharfenberger | 239/708 |
| 4,217,062 | 8/1980 | Trp et al. | 417/477 |
| 4,228,930 | 10/1980 | Hogan | 417/477 |
| 4,231,668 | 11/1980 | Groth et al. | 417/477 |
| 4,275,834 | 6/1981 | Spanjersberg et al. | 239/3 |
| 4,313,475 | 2/1982 | Wiggins | 141/18 |
| 4,413,788 | 11/1983 | Schaefer et al. | 239/703 |
| 4,424,011 | 1/1984 | O'Brien et al. | 417/477 |
| 4,522,571 | 6/1985 | Little | 417/476 |
| 4,530,647 | 7/1985 | Uno | 417/477 |
| 4,639,156 | 1/1987 | Stern et al. | 417/477 |
| 4,660,607 | 4/1987 | Griffith et al. | 251/4 |
| 4,660,771 | 4/1987 | Chabert et al. | 239/708 |

FOREIGN PATENT DOCUMENTS

| | | | |
|---|---|---|---|
| 891191 | 8/1953 | Fed. Rep. of Germany . | |
| 973454 | 2/1960 | Fed. Rep. of Germany . | |
| 2458693 | 2/1981 | France | 417/477 |
| 764494 | 12/1956 | United Kingdom . | |
| 1393333 | 5/1975 | United Kingdom . | |
| 1478853 | 7/1977 | United Kingdom . | |
| 2009486 | 6/1979 | United Kingdom . | |

*Primary Examiner*—Douglas C. Butler
*Assistant Examiner*—Christopher G. Trainor
*Attorney, Agent, or Firm*—Barnes & Thornburg

[57] ABSTRACT

A coating material dispensing system includes an electrostatic high potential supply having an output terminal on which the supply maintains a high electrostatic potential, a source of coating material, a dispenser for dispensing the coating material, and appropriate fluid and electric circuits for coupling the dispenser to the source of coating material and the output terminal to the dispenser to supply potential to the coating material dispensed by the dispenser. The fluid circuit coupling the dispenser to the source of coating material includes a peristaltic voltage block having multiple coils of a resilient conduit and a rotor for supporting means for contacting each coil at multiple contact points. The peristaltic voltage block substantially divides the flow of coating material to the dispenser into discrete slugs of coating material substantially to interrupt the electrical path through the coating material from the terminal to the coating material supply.

14 Claims, 3 Drawing Sheets

PERISTALTIC VOLTAGE BLOCK

This invention relates to electrostatically aided coating material atomization and dispensing systems and primarily to such systems which are capable of atomizing and dispensing conductive coating materials.

A problem with such systems has always been that, unless they were equipped with so-called voltage blocks, currents could flow between the electrostatic potential supply and grounded coating material supplies through the conductive coating material. Throughout this application, the term "voltage block" is used to describe both the prior art and the devices of the invention. It is to be understood, however, that these devices function to minimize, to the extent they can, the flow of current. Such current otherwise would flow from a dispensing device maintained at high electrostatic potential through the conductive coating material being dispensed thereby to the grounded source of such coating material, degrading the electrostatic potential on the dispensing device. Attempts to prevent this by isolating the coating material supply from ground result in a fairly highly charged coating material supply several thousand volts from ground. This in turn gives rise to the need for safety equipment, such as high voltage interlocks to keep personnel and grounded objects safe distances away from the ungrounded coating material supply.

Various types of voltage blocks are illustrated and described in the following listed U.S. patents and foreign patent specifications: U.S. Pat. Nos.: 1,655,262; 2,673,232; 3,098,890; 3,291,889; 3,360,035; 4,020,866; 3,122,320; 3,893,620; 3,933,285; 3,934,055; 4,017,029; 4,275,834; 4,313,475; 4,085,892; 4,413,788; British patent specification 1,478,853; and British patent specification No. 1,393,313. Peristaltic pumps are known. There are, for example, the pumps illustrated and described in the following listed U.S. patents and foreign patent specifications: British patent specification No. 2,009,486; British patent specification No. 764,494; German patent specification No. 891,191; German patent specification No. 973,454; U.S. Pat. No. 3,644,068; U.S. Pat. No. 2,414,355; U.S. Pat. No. 2,547,440; and U.S. Pat. No. 3,732,042. As used herein the term "pump" includes pumps, metering devices and motors because devices constructed according to the invention can be driven by motors to pump or to meter coating material through the circuit or be driven as motors by pressurized coating material which is maintained under pressure from some other source, such as a pressure head maintained at the coating material supply, or another coating material pump in series in the coating material delivery circuit between the coating material supply and the peristaltic pump.

Additionally it is known to use certain types of pumps which divide fluid streams into discrete slugs of fluid to keep currents from flowing in these fluid streams. There is, for example, the system illustrated and described in U.S. Pat. No. 3,866,678.

It is an object of the present invention to provide an improved voltage block for use in electrostatically aided coating material atomization and dispensing systems.

According to the invention, a coating material dispensing system comprises an electrostatic high potential supply having an output terminal on which the supply maintains a high electrostatic potential, a source of coating material, a dispenser for dispensing the coating material, a delivery conduit for coupling the dispenser to the source of coating material, means for coupling the output terminal to the dispenser to supply potential to the coating material dispensed by the dispenser and a pump for dividing the coating material in the delivery conduit into discrete slugs of coating material substantially to interrupt the electrical path through the coating material from the terminal to the coating material supply.

Illustratively, according to the invention the Pump comprises a peristaltic pump.

Further illustratively according to the invention the peristaltic pump comprises a length of resilient conduit having an inlet end and an outlet end for coupling in the delivery conduit between the source of coating material and the dispenser, a housing having an interior wall against which the resilient conduit lies, a rotor, and means for rotatably mounting the rotor within the housing. The rotor supports means for contacting the resilient conduit. The contacting means compresses the resilient conduit against the interior wall of the housing substantially to separate the coating material carried thereby into slugs.

Additionally illustratively according to an embodiment of the invention, the interior wall is generally right circular cylindrical in configuration and the length of resilient conduit is formed into somewhat of a helix around the interior wall.

In addition, according to an illustrative embodiment of the invention the flexible tubing is generally flat when it is empty.

Further illustratively according to an embodiment of the invention, the interior wall is generally frustoconical in configuration and the length of resilient conduit is formed somewhat into a spiral wrapped around the interior wall.

Additionally according to an illustrative embodiment of the invention, the peristaltic pump comprises a length of flexible conduit having an inlet end and an outlet end for coupling in the delivery conduit between the source of coating material and the dispenser, a mandrel having an exterior wall against which the resilient conduit lies, a rotor, and means for rotatably mounting the rotor to surround the mandrel. The rotor supports means for contacting the resilient conduit. The contacting means compresses the resilient conduit against the exterior wall of the mandrel substantially to separate the coating material carried thereby into slugs.

Illustratively according to this embodiment of the invention, the exterior wall is generally right circular cylindrical in configuration and the length of resilient conduit is formed into somewhat of a helix around the exterior wall.

According to another aspect of the invention, a coating material dispensing system comprises an electrostatic high potential supply having an output terminal on which the supply maintains a high electrostatic potential, a source of coating material, a dispenser for dispensing the coating material, means for coupling the dispenser to the source of coating material, and means for coupling the output terminal to the dispenser to supply potential to the coating material dispensed by the dispenser. The means for coupling the dispenser to the source of coating material comprises a peristaltic voltage block for substantially dividing the flow of coating material to the dispenser into discrete slugs of coating material substantially to interrupt the electrical path through the coating material from the terminal to the coating material supply.

The invention may best be understood by referring to the following description and accompanying drawings which illustrate the invention. In the drawings.

Figure 1:
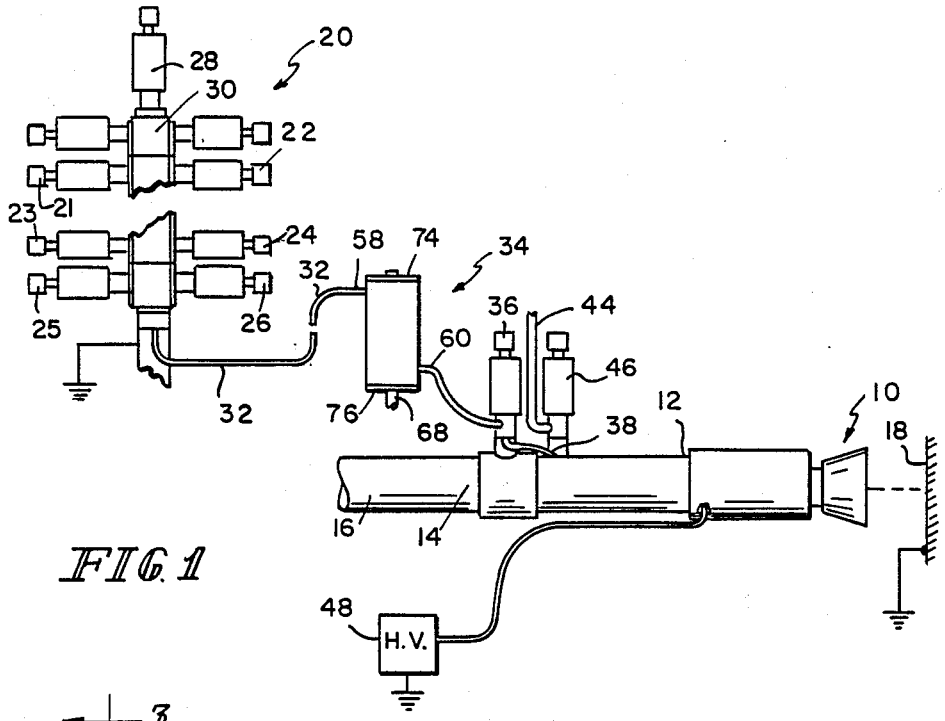
FIG. 1 illustrates a diagrammatic side elevational view of a system constructed according to the present invention.

In FIG. 1, a dispensing device 10 and some of the related electrical, liquid and pneumatic equipment for its operation are illustrated. Dispensing device 10 is mounted from one end 12 of a support 14, the other end 16 of which can be mounted to permit movement of dispensing device 10 as it dispenses coating material onto an article 18 to be coated, a "target," passing before it. Support 14 is constructed from an electrical insulator to isolate dispensing device 10 from ground potential.

The system further includes a color manifold 20, illustrated fragmentarily. Color manifold 20 includes a plurality of illustratively air operated color valves, six, 21-26 of which are shown. These color valves 21-26 control the flows of various selected colors of coating material from individual supplies (not shown) into the color manifold 20. A solvent valve 28 is located at the head 30 of color manifold 20. A supply line 32, which is also maintained at ground potential, extends from the lowermost portion of color manifold 20 through a peristaltic voltage block 34 to a triggering valve 36 mounted adjacent dispensing device 10. A feed tube 38 is attached to the output port of triggering valve 36. Feed tube 38 feeds a coating material flowing through a selected one of color valves 21-26 and manifold 20 into supply line 32, through voltage block 34, triggering valve 36, feed tube 38 and into the interior of dispensing device 10. Operation of device 10 atomizes this selected color of coating material.

For purposes of cleaning certain portions of the interior of device 10 during the color change cycle which typically follows the application of coating material to each target 18 conveyed along a grounded conveyor (not shown) past device 10, a line extends from a pressurized source (not shown) of solvent through a tube 44 and a valve 46 to device 10. Tube 44 feeds solvent into device 10 to remove any remaining amounts of the last color therefrom before dispensing of the next color begins.

The coating material dispensed by device 10 moves toward a target 18 moving along the grounded conveyor due, in part, to electric forces on the dispensed particles of the coating material. To impart charge to the particles of coating material and permit advantage to be taken of these forces, an electrostatic high potential supply 48 is coupled to device 10. Supply 48 may be any of a number of known types.

Figure 2:
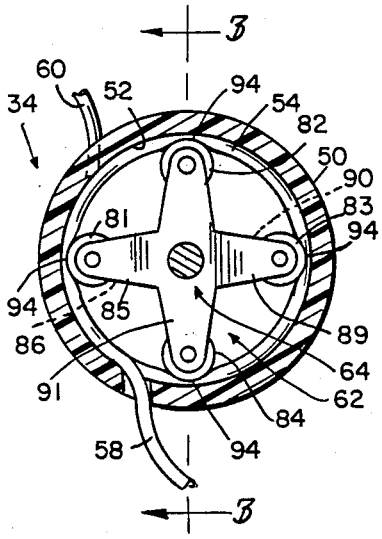
FIG. 2 illustrates a sectional end elevational view of a detail of the system of FIG. 1, taken generally along section lines 2—2 thereof.
Figure 3:
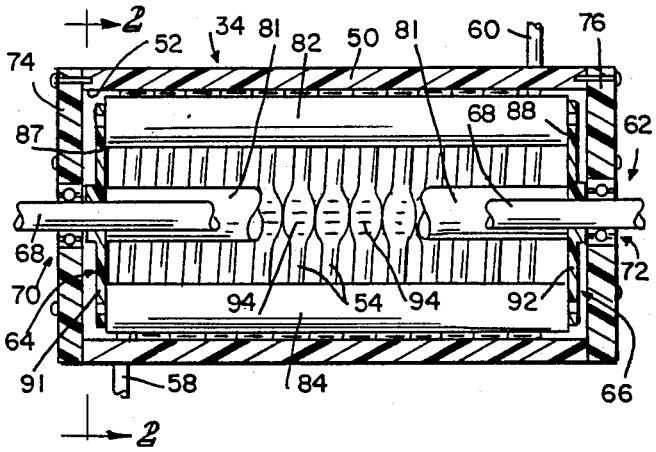
FIG. 3 illustrates a sectional side elevational view of the detail of FIG. 2, taken generally along section lines 3—3 thereof.

Turning now to FIGS. 2-3, the peristaltic voltage block, or "pump" 34 of the system of FIG. 1 comprises a housing 50 having a generally right circular cylindrical interior wall 52. A length 54 of soft resilient tubing is wound helically around the interior wall 52. The tubing 54 can have any suitable cross-sectional configuration, such as circular, or can be so-called "lay-flat" tubing which is flat when empty. The tubing 54 includes an inlet end 58 and an outlet end 60 for coupling the pump 34 into the circuit 32, 36, 38 between the source of coating material and the device 10.

The peristaltic pump 34 includes a rotor 62 having a pair 64, 66 of somewhat cross- or X-shaped end plates non-rotatably joined to each other by a shaft 68. The shaft 68 is journaled 70, 72 for rotation in a pair 74, 76 of end plates with which the housing 50 is provided. Rollers 81-84 are rotatably supported between respective arms 85, 86; 87, 88; 89, 90; 91, 92 of the two cross-shaped end plates 64, 66. The rollers 81-84 push the tubing 54 against the interior sidewall 52 of the housing 50 with sufficient force to evacuate substantially all coating material from the interior of the tubing 54 in the regions 94 where the rollers 81-84 contact it. This results in substantial isolation of slugs of coating material between adjacent contact points 94 of the rollers 81-84 with the tubing 54. The flat configuration of the tubing 54 when it is empty aids to make this isolation possible. Because adjacent slugs of coating material are substantially isolated, minimal current flows between them. Thus, the potential between the device 10 and the target 18 to be coated by coating material dispensed therefrom can be maintained by the electrostatic high potential supply 48, even though the coating material itself is conductive.

The pump 34 is driven by a prime mover (not shown), the rotation rate of which is controlled to insure delivery of coating material at a desired flow rate and coating material dispensing rate to device 10.

Figure 4:
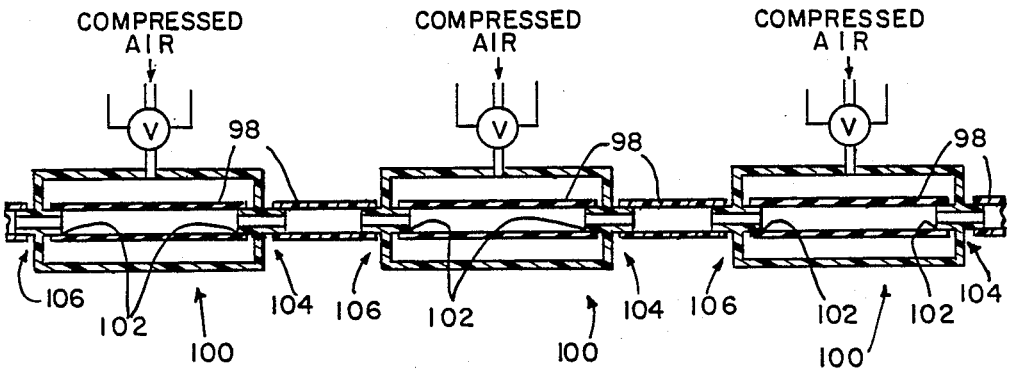
FIG. 4 illustrates a diagrammatic fragmentary longitudinal sectional view of an alternative to the structure of FIGS. 2-3.

In another embodiment of the peristaltic pump illustrated in FIG. 4, a flexible, resilient, elastic conduit 98 is provided along its length with pressure boxes 100. Seals 102 are provided between the inlet 104 and outlet 106 ends of the pressure boxes 100 and the conduit 98. A distribution system (not shown) is provided for the peristaltic pressurization of the pressure boxes 100 to pump coating material along the conduit 98.

In another embodiment of the invention, illustrated in FIGS. 5-8, a peristaltic pump 120 includes a central right circular cylindrical mandrel 122 surrounded by a relatively rotatable framework 124 which somewhat defines a cylinder which is coaxial with mandrel 122 but is relatively rotatable with respect thereto. Framework 124 rotatably supports four rollers 126 at ninety degree intervals about the axis of mandrel 122 and framework 124. Framework 124 supports rollers 126 in closely spaced relation to the right circular cylindrical outer surface 130 of mandrel 122. Pump 120 also includes a removable, replaceable conduit-providing cartridge 132. Cartridge 132 includes a generally right circular cylindrical reinforced flexible resilient core 134 on the outer surface 136 of which multiple turns 138 of a helically oriented circular cross section conduit 140 are provided. The cartridge 132 is slightly elastic and stretchable to aid in its installation onto and removal from the mandrel 122. The framework, with its relatively rotatably mounted rollers 126 then slips over cartridge 132 compressing the regions 142 of conduit 140 in contact with rollers 126 as it goes. The sidewall of conduit 140 is compressed substantially into contact with itself in these regions 142, so that when a coating material is being pumped through the conduit 140 the coating material is effectively divided into discrete slugs, substantially blocking the voltage maintained on a dispensing device coupled to the output end 146 of conduit 140 from a grounded coating material supply coupled to the input end 148 of conduit 140. A ring gear (not shown) can be formed on framework 124 for engagement by a gear of a motor to pump coating material through pump 120. Framework 124 can be split, for example, diametrically into two portions which are hinged together to assist in placing framework 124 over the cartridge 132 mounted on mandrel 122.

Figure 9:
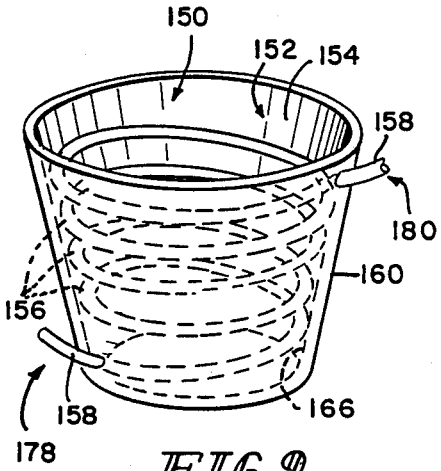
FIG. 9 illustrates a partly longitudinal sectional perspective view of certain details of another system constructed according to the present invention.
Figure 10:
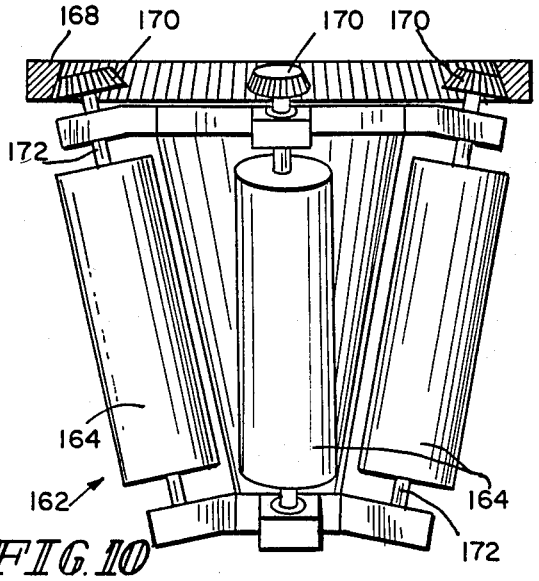
FIG. 10 illustrates a partly fragmentary side elevational of certain details of the embodiment of the invention, details of which are illustrated in FIG. 9; and, FIG. 11 illustrates a fragmentary sectional side elevational view of another system constructed according to the present invention.

In another embodiment of the invention, illustrated in FIGS. 9–10, the mounting of the rollers in tight-fitting contact with the conduit is dealt with in another way. The cartridge 150 in this embodiment is formed from a generally frustoconically shaped reinforced flexible resilient core 152 on the inner surface 154 of which multiple turns 156 of circular cross section conduit 158 are provided. This cartridge 150 easily slips into a frustoconically tapered housing 160. A rotor 162 rotatably supports four rollers 164. The rotational axis of rotor 162 makes the same angle with the rotational axes of rollers 164 as the sidewall 166 of housing 160 makes with its axis. Housing 160 includes a bevelled ring gear 168 at its larger open end. Rollers 164 have bevelled planetary gears 170 provided on their respective shafts 172. The bevels of ring and planetary gears 168, 170, respectively, permit their engagement when rotor 162 is slipped into housing 160 and loaded into conduit 158-compressing engagement with cartridge 150. End caps (not shown) of housing 160 rotatably support and retain rotor 162 in housing 160. The sidewall of conduit 158 is compressed substantially into contact with itself in regions thereof in contact with rollers 164, so that when a coating material is being pumped through conduit 158 the coating material is effectively divided into discrete slugs, substantially blocking the voltage maintained on a dispensing device coupled to the output end 178 of conduit 158 from a grounded coating material supply coupled to the input end 180 of conduit 158.

Figure 11:
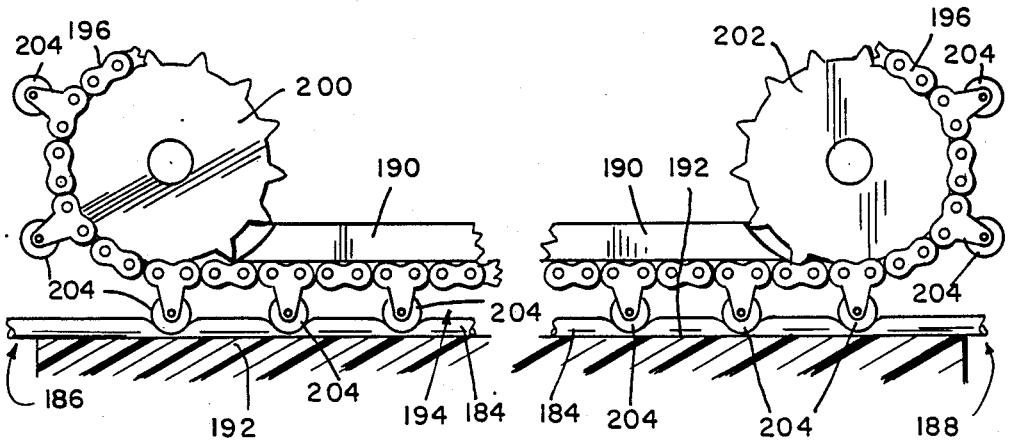
Figure 5:
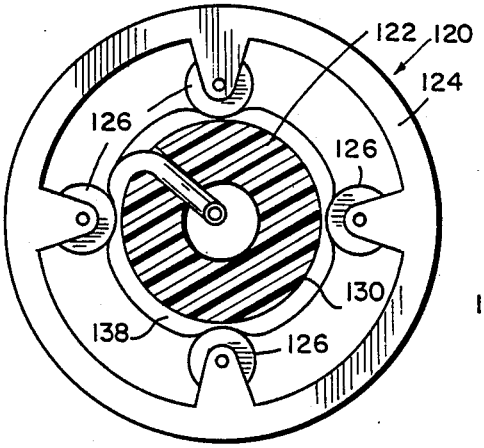
FIG. 5 illustrates a sectional end view of another system constructed according to the present invention.
Figure 6:
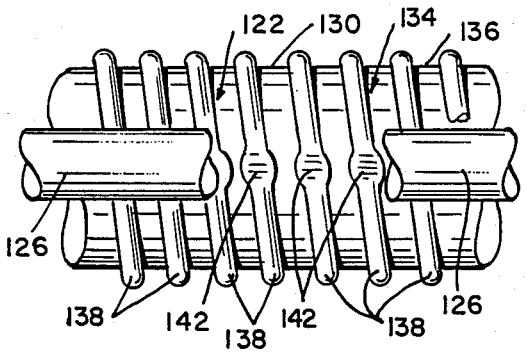
FIG. 6 illustrates a diagrammatic and fragmentary side elevational view of the system illustrated in FIG. 5.
Figure 7:
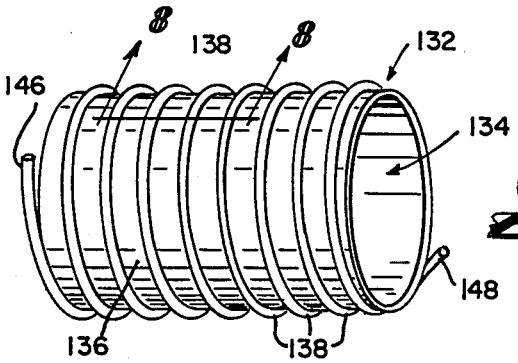
FIG. 7 illustrates a perspective view of an alternative detail of the system illustrated in FIGS. 5-6.
Figure 8:
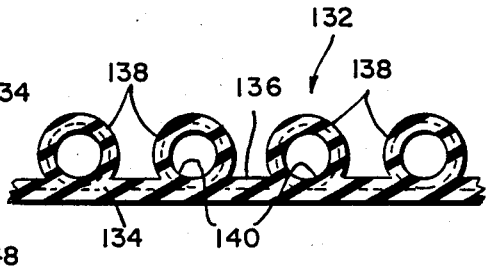
FIG. 8 illustrates an enlarged fragmentary sectional view of a portion of the detail of FIG. 7, taken generally along section lines 8—8 of FIG. 7.

In another linear embodiment of the invention, illustrated in FIG. 11, a circular cross section conduit 184 has an input end 186 coupled to a grounded coating material supply and an output end 188 coupled to a dispensing device maintained at high electrostatic potential. Conduit 184 extends between upper 190 and lower 192 pressure pads between its input and output ends 186, 188, respectively. One run 194 of a roller chain 196 also extends between upper and lower pressure pads 190, 192. Roller chain 196 is trained about chain 196-driving and -driven sprockets 200, 202 rotatably mounted adjacent the input and output ends 186, 188, respectively, of conduit 184. Alternate links of roller chain 196 rotatably support rollers 204 which contact conduit 184 when the links are between pressure pads 190, 192. The spacing between pads 190 and 192 is such that rollers 204 compress the sidewall of conduit 184 substantially into contact with itself in the regions of contact of rollers 204 with conduit 184. When coating material is being pumped or metered through conduit 184, the coating material is effectively divided into discrete slugs, substantially blocking the voltage maintained on a dispensing device coupled to the output end 188 of conduit 184 from a grounded coating material supply coupled to the input end 186 of conduit 184.

What is claimed is:

1. A coating material dispensing system comprising an electrostatic high potential supply having an output terminal on which the supply maintains a high electrostatic potential, a source of coating material, a dispenser for dispensing the coating material, means for coupling the dispenser to the source of coating material, means for coupling the output terminal to the dispenser to supply potential to the coating material dispensed by the dispenser, and a peristaltic device having multiple coils of a resilient conduit and a rotor for supporting means for contacting each coil at multiple contact points for substantially dividing the coating material in the peristaltic device into discrete slugs of coating material substantially to interrupt the electrical path through the coating material from the terminal to the coating material supply.

2. The system of claim 1 wherein the peristaltic device comprises an inlet end for coupling to the source of coating material and an outlet end for coupling to the dispenser, and a housing having an interior wall against which the resilient conduit lies, the contacting means compressing the resilient conduit against the interior wall of the housing substantially to separate the coating material carried thereby into slugs.

3. The system of claim 2 wherein the interior wall is generally right circular cylindrical in configuration and the multiple coils of resilient conduit are formed into somewhat of a helix around the interior wall.

4. The system of claim 3 wherein the resilient conduit is generally flat when it is empty.

5. The system of claim 2 wherein the interior wall is generally frustoconical in configuration and the multiple coils of resilient conduit are formed somewhat into a spiral wrapped around the interior wall.

6. The system of claim 1 wherein the peristaltic device comprises an inlet end for coupling to the source of coating material and an outlet end for coupling to the dispenser, and a mandrel having an exterior wall against which the resilient conduit lies, the contacting means compressing the resilient conduit against the exterior wall of the mandrel substantially to separate the coating material carried thereby into slugs.

7. The system of claim 6 wherein the exterior wall is generally right circular cylindrical in configuration and the multiple coils of resilient conduit are formed into somewhat of a helix around the exterior wall.

8. A coating material dispensing system comprising an electrostatic high potential supply having an output terminal on which the supply maintains a high electrostatic potential, a source of coating material, a dispenser for dispensing the coating material, means for coupling the dispenser to the source of coating material, and means for coupling the output terminal to the dispenser to supply potential to the coating material dispensed by the dispenser, the means of coupling the dispenser to the source of coating material comprising a peristaltic voltage block having multiple coils of a resilient conduit and a rotor for supporting means for contacting each coil at multiple contact points for substantially dividing the flow of coating material to the dispenser into discrete slugs of coating material substantially to interrupt the electrical path through the coating material from the material to the coating material supply.

9. The system of claim 8 wherein the peristaltic voltage block comprises an inlet end for coupling to the source of coating material, an outlet end for coupling to the dispenser, and a housing having an interior wall against which the resilient conduit lies, the contacting means compressing the resilient conduit against the interior wall of the housing substantially to separate the coating material carried thereby into slugs.

10. The system of claim 9 wherein the interior wall is generally right circular cylindrical in configuration and the multiple coils of resilient conduit are formed into somewhat of a helix around the interior wall.

11. The system of claim 10 wherein the resilient conduit is generally flat when it is empty.

12. The system of claim 9 wherein the interior wall is generally frustoconical in configuration and the multiple coils of resilient conduit are formed somewhat into a spiral wrapped around the interior wall.

13. The system of claim 8 wherein the peristaltic voltage block comprises an inlet end for coupling to the source of coating material, an outlet end for coupling to the dispenser, and a mandrel having an exterior wall against which the resilient conduit lies, the contacting means compressing the resilient conduit against the exterior wall of the mandrel substantially to separate the coating material carried thereby into slugs.

14. The system of claim 13 wherein the exterior wall is generally right circular cylindrical in configuration and the multiple coils of resilient conduit are formed into somewhat of a helix around the exterior wall.

* * * * *